US005269211A

United States Patent [19]

Flaming

[11] Patent Number: 5,269,211

[45] Date of Patent: Dec. 14, 1993

[54] METHOD AND APPARATUS FOR SEVERING WORK OBJECTS

[76] Inventor: Max L. Flaming, 5866 E. Alta St., Fresno, Calif. 93727

[21] Appl. No.: 843,237

[22] Filed: Feb. 28, 1992

[51] Int. Cl.[5] ..... B26F 3/00

[52] U.S. Cl. ..... 83/39; 83/53; 83/177; 83/404.1; 493/362; 493/369

[58] Field of Search ..... 83/53, 177, 447, 404.1, 83/404.2, , 39; 493/361, 362, 369, 363

[56] References Cited

U.S. PATENT DOCUMENTS

| | | | |
|---|---|---|---|
| 3,038,508 | 6/1962 | Wilson | 83/447 X |
| 4,006,656 | 2/1977 | Shinomiya | 83/177 X |
| 4,216,906 | 8/1980 | Olsen et al. | 83/177 X |
| 4,246,838 | 1/1981 | Pulver et al. | 83/177 X |
| 4,641,555 | 2/1987 | Johnson et al. | 83/404.2 X |
| 4,931,140 | 6/1990 | Peltula et al. | 83/53 X |
| 5,031,496 | 7/1991 | Lobash et al. | 83/177 X |
| 5,083,487 | 1/1992 | Croteau | 83/53 X |

*Primary Examiner*—Richard K. Seidel
*Assistant Examiner*—Kenneth E. Peterson
*Attorney, Agent, or Firm*—Worrel & Worrel

[57] ABSTRACT

A method for severing work objects constructed of laminate materials including establishing a high pressure jet of fluid passing substantially along a longitudinal axis; placing the work object and the jet of fluid in alignment with each other so that the jet of fluid intersects the work object; and moving the work object and jet of fluid relative to each other to sever the work object with the jet of fluid.

An apparatus for severing work objects constructed of laminate materials, the apparatus having a conveyor for transporting the work objects along a path of travel; a system for directing a high pressure jet of fluid along an axis; a beam mounting the directing system in juxtaposition to the conveyor with the axis intersecting the conveyor; and a moving assembly operable to move the beam substantially transversely of the path of travel whereby the work objects are successively severed by the jet of fluid into configurations defined by movement of the work objects in the path of travel and by movement of the beam and thereby the jet of fluid.

7 Claims, 4 Drawing Sheets

METHOD AND APPARATUS FOR SEVERING WORK OBJECTS

BACKGROUND OF THE INVENTION

1. Field of the Invention

The present invention relates to a method and apparatus for severing work objects and, more particularly, to such a method and apparatus which have particular utility in severing laminate materials cleanly and precisely without damage to the severed edges thereof while possessing the capability of producing intricate configurations and which can achieve such operational objectives on an assembly line basis.

2. Description of the Prior Art

The manufacture of products, particularly where manufactured on an assembly line basis, presents unique difficulties which may not be encountered in the construction of a single, or a small number of such products. While most products could be hand fabricated with the precision and operational objectives which may be desired, the necessity for the mass production of such products frequently requires that these operational objectives be compromised. While some of these compromises may be tolerable, others may simply render the product, as originally conceived, impractical. However, even in the case of the compromises which can be tolerated, the desirability of avoiding such compromises may be substantial.

In the manufacture of containers, for example, it has been known to employ laminated cardboard, paperboard, or boxboard, to achieve a number of attractive operational benefits. One beneficial form of construction calls for a pair of end walls of rather substantial thickness to be employed, about which is extended a wrapper so as to form a container having flaps which can be folded into sealing relation to the interior of the container. The wrapper is of relatively thin construction which permits it conveniently and precisely to be cut from a panel of such material. The end walls, however, are of such a thickness that such severing is difficult without some degree of damage thereto.

One material from which such end walls have been fabricated is triple wall corrugated boxboard laminate material. This is a laminated cardboard, or boxboard, material having three layers of corrugated cardboard with each layer consisting of one corrugated sheet overlaid on opposite sides by flat sheets. This form of construction for the end walls is particularly desirable because it is very strong, holding its shape during assembly of the container and in use while being of very light weight and inexpensive construction. However, conventional methods for manufacturing such end walls require sawing through the laminated triple wall material using circular saws or the like. The action of such saws typically crushes the flutes of the corrugated laminations along the courses of such severing weakening the integrity of the end walls. Furthermore, conventional methods are incapable of staying within the optimum design tolerances thereby interfering with the assembly and use of the containers so formed.

These problems in the formation of end walls from such triple wall laminate material are compounded when the containers are to be of the interlocking type having projections along the upper edges of the end walls and recesses in the lower edges of the end walls. Such containers are operable to interfit with each other wherein the projections of a lower container mate with the recesses of a container immediately thereabove to form a stack of substantially increased unitary integrity. Conventional construction methods call for such projections and recesses to be formed in the end walls using saws, or other types of cutting blades. The saws are required to follow paths relative to the end walls which are intricate and create even greater stress on the corrugated layers of the triple wall material than in the case of end walls without projections or recesses. This stress results in rather significant damage to the marginal edges of the end walls so formed. The flutes of the corrugations are frequently crushed. Portions of the laminate layers fray or tear away entirely. Even more damaging, the optimum design tolerances for the projections and recesses are extended to the point of significantly diminished utility.

As a direct consequence, the containers so formed frequently do not have projections and recesses which can adequately interfit when the containers are disposed in stacked relation thereby presenting a myriad of problems in the formation, packing, transport, storage and unpacking of such containers. The projections may be so weakened as to collapse under the weight, or lateral adjustment, of a container rested thereon during stacking. Furthermore, the weakening of the marginal edges of the end walls in such conventional forming operations significantly weakens the overall structural integrity of such containers otherwise producing less than desirable consequences.

Therefore, it has long been known that it would be desirable to have a method and apparatus for severing work objects which are operable to form such work objects within tolerances not heretofore achieved in the art and are capable of unvarying precision throughout a long operational life; which have particular utility in the severing of laminate work objects such as end walls employed in the construction of containers; which are operable to form work objects from such laminate materials having intricately formed marginal edges; and which are fully capable of the mass production of such work objects with unvarying accuracy without the host of difficulties presented by prior art methods and apparatuses.

SUMMARY OF THE INVENTION

Therefore, it is an object of the present invention to provide an improved method and apparatus for severing work objects.

Another object is to provide such a method and apparatus which have particular utility in the severing of laminate materials, having relatively fragile portions, capable of forming configurations of intricate design having marginal edges which are well within tolerances not heretofore achieved in the art and without damage to the structural integrity thereof even at the marginal edges themselves.

Another object is to provide such a method and apparatus which are particularly well suited to the formation of triple wall corrugated cardboard, or boxboard, end walls such as are used in the manufacture of containers having a pair of such end walls and about which is extended a wrapper to form a container for the packing of a wide variety of products including fresh fruits and vegetables.

Another object is to provide such a method and apparatus which are operable to permit the manufacture on a mass production, assembly line basis of end walls employed in the formation of containers.

Another object is to provide such a method and apparatus which have particular utility in the formation of end walls having upper edges from which a pair of projections are extended and lower edges in which are formed recesses adapted to mate with the projections of the end walls of other containers of the same design permitting such containers to be interlocked in a stack for purposes of transport and storage.

Another object is to provide such a method and apparatus which constitute a significant improvement upon the conventional practice of using saw blades, or knives, to cut through the laminate material characteristically damaging the marginal edges thereof, exceeding the design tolerances which would be desirable and otherwise reducing the structural integrity of the containers formed therefrom.

Another object is to provide such a method and apparatus which are operable to manufacture such work objects with a speed and precision not heretofore achieved in the art while avoiding the deleterious byproducts of such conventional construction practices such as the formation of saw dust and trash presenting problems of disposal as well as health and fire hazards.

Another object is to provide such a method and apparatus which can readily be modified for the mass production of other work objects having different configurations by the computerized control thereof.

Another object is to provide such a method and apparatus which achieve all of the benefits thereof while being operable at a cost well within those found acceptable within the industry using conventional methods and apparatuses.

These and other objects and advantages are achieved, in the preferred embodiment of the method and apparatus of the present invention, by establishing a high pressure jet of fluid passing substantially along a longitudinal axis; placing the work object and fluid jet in alignment with each other so that the fluid jet intersects the work object; and moving the work object and the fluid jet relative to each other to sever the work object with the fluid jet.

DESCRIPTION OF THE PREFERRED EMBODIMENT

Figure 1:
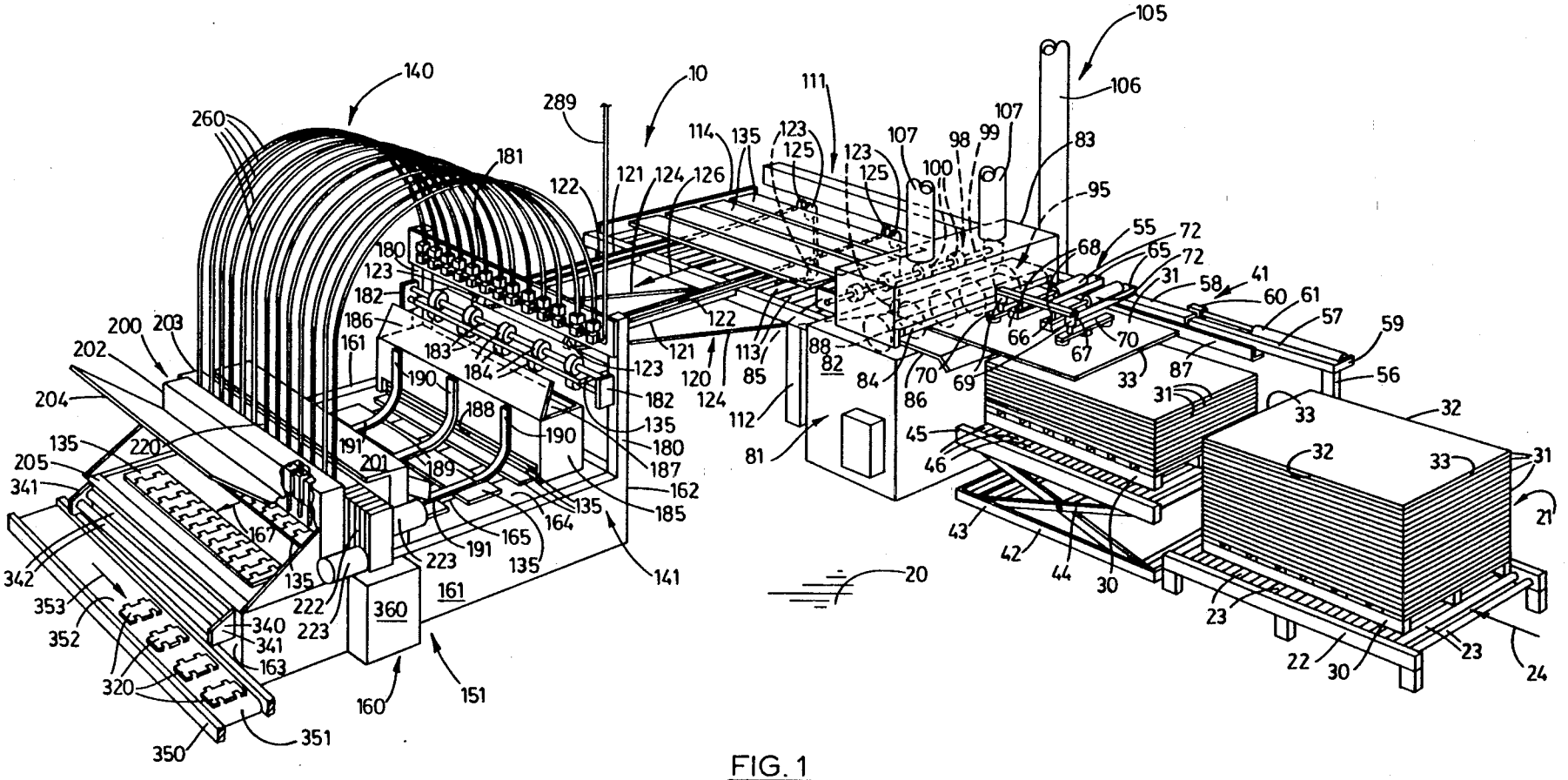
FIG. 1 is a fragmentary perspective view of the apparatus of the present invention operable in the practice of the method of the present invention.

Referring more particularly to the drawings, the apparatus for severing work objects of the present invention operable in the practice of the method hereof is generally indicated by the numeral 10 in FIG. 1. The apparatus is shown in FIG. 1 in a typical arrangement for the mass production on an assembly line basis of the work objects employing the method of the present invention. As shown therein, the apparatus 10 is disposed on a supporting surface 20, such as a concrete floor. The apparatus has a first work station, or panel receiving station, 21 including a support frame 22 mounting a plurality of rollers 23 mounted on the frame for rotational movement about substantially parallel longitudinal axes of rotation. The rollers define a path of travel 24.

As shown in FIG. 1, a pallet 30 is rested on the rollers 23 of the support frame 22 and has a plurality of panels 31 rested thereon in stacked relation. Each of the panels has opposite side edges 32 and opposite end edges 33. Each of the panels is constructed of a plurality of paper laminations including four (4) flat paper laminations 34 and three (3) corrugated paper laminations 35. As can, perhaps, best be visualized upon reference to FIG. 4, each corrugated paper lamination is bounded on opposite sides by flat paper laminations. This combination of laminations is known in the container industry as "triple wall corrugated cardboard, or boxboard, material."

The apparatus 10 has a second work station, or panel loading station, 41 including a lifting frame 42 consisting of a base frame 43, rested on the supporting surface 20, mounting a scissors lifting assembly 44 on which, in turn, is mounted a support frame 45. Using a suitable lifting mechanism, not shown, the scissors lifting assembly 44 is operable to raise and lower the support frame 45 relative to the base frame 43. A plurality of rollers 46 are mounted on the support frame 45 for rotational movement about individual axes of rotation substantially parallel to each other and substantially parallel to the axes of rotation of the rollers 23 of the support frame 22.

A panel loading assembly 55 is mounted in the panel loading station 41. The panel loading assembly includes an upright frame 56 mounted on the supporting surface 20 laterally with respect to the support frame 45. A horizontal tubular guide beam 57 is mounted on the upright frame extending in spaced substantially parallel relation to the support frame 45. A slide member 58 is slidably mounted on the horizontal tubular guide beam for slidable movement therealong. A cylinder mount 59 is mounted on the end of the horizontal tubular beam extending laterally thereof. A cylinder rod mount 60 is mounted on the slide member 58 extending laterally thereof. A hydraulic cylinder assembly 61 is mounted on and operably interconnects the cylinder mount 59 and cylinder rod mount 60. The hydraulic cylinder assembly is operable to move the slide member 58 along the horizontal tubular guide beam.

Support arms 65 are individually mounted on the slide member 58 extending therefrom in parallel relation over the support frame 45. Each of the support arms has a track 66 extending along the upper surface of the support arm. A cross member 67 has followers 68 mounted thereon and individually received for slidable movement in the tracks 66 of the support arms 65. Air cylinders 69 are individually mounted on the undersides of the opposite ends of the cross arm and individually have vacuum cup mounting plates 70 mounted on the air cylinders, as best shown in FIG. 1. Three (3) vacuum cups 71 are individually mounted on the underside of each of the vacuum cup mounting plates 70. A pneumatic system, not shown, is connected in air supplying relation to the air cylinder 69 operable to move the vacuum cup mounting plates 70 toward or from the support frame 45, as will hereafter be made more clearly apparent. Similarly, a vacuum system, not shown, is individually operably connected to the vacuum cups 71 operable to draw a vacuum through the vacuum cups as desired for purposes hereinafter to be described. Hydraulic cylinder assemblies 72 are individually mounted on the support arms 65 and operably connected to the followers 68 of the cross member 67. The hydraulic cylinder assemblies are operable through a hydraulic system, not shown, to move the cross member, and thereby the vacuum cups 71, outwardly, or inwardly along the support arms as permitted by the follower 68 within the tracks 66.

The apparatus 10 includes a third work station, or panel cutting station, 81 immediately adjacent to the second work station 41. The panel cutting station includes a main housing 82 on which is mounted an upper housing 83. The upper housing has an entrance opening 84 dimensioned so as to be adapted to receive one of the panels 31 therethrough. The upper housing has a discharge opening 85 at the rear thereof of approximately the same dimensions as the entrance opening. An entrance platform 86 is mounted on the upper housing beneath the entrance opening to provide a guide surface for entrance into the entrance opening. A panel guide rail 87 is mounted on the upper housing with its surface disposed in right angular relation to the entrance opening and extending substantially parallel to and above the support frame 45 in substantially right angular relation to the rollers 46 thereof. An intake feed roller 88 is mounted within the upper housing above the entrance opening 84. A suitable drive system, not shown, is provided for rotating the intake feed roller. The intake feed roller is engageable with each successive panel so as to be operable to pull each successive panel into and through the upper housing upon engagement of the intake feed roller with the panel.

Figure 2:
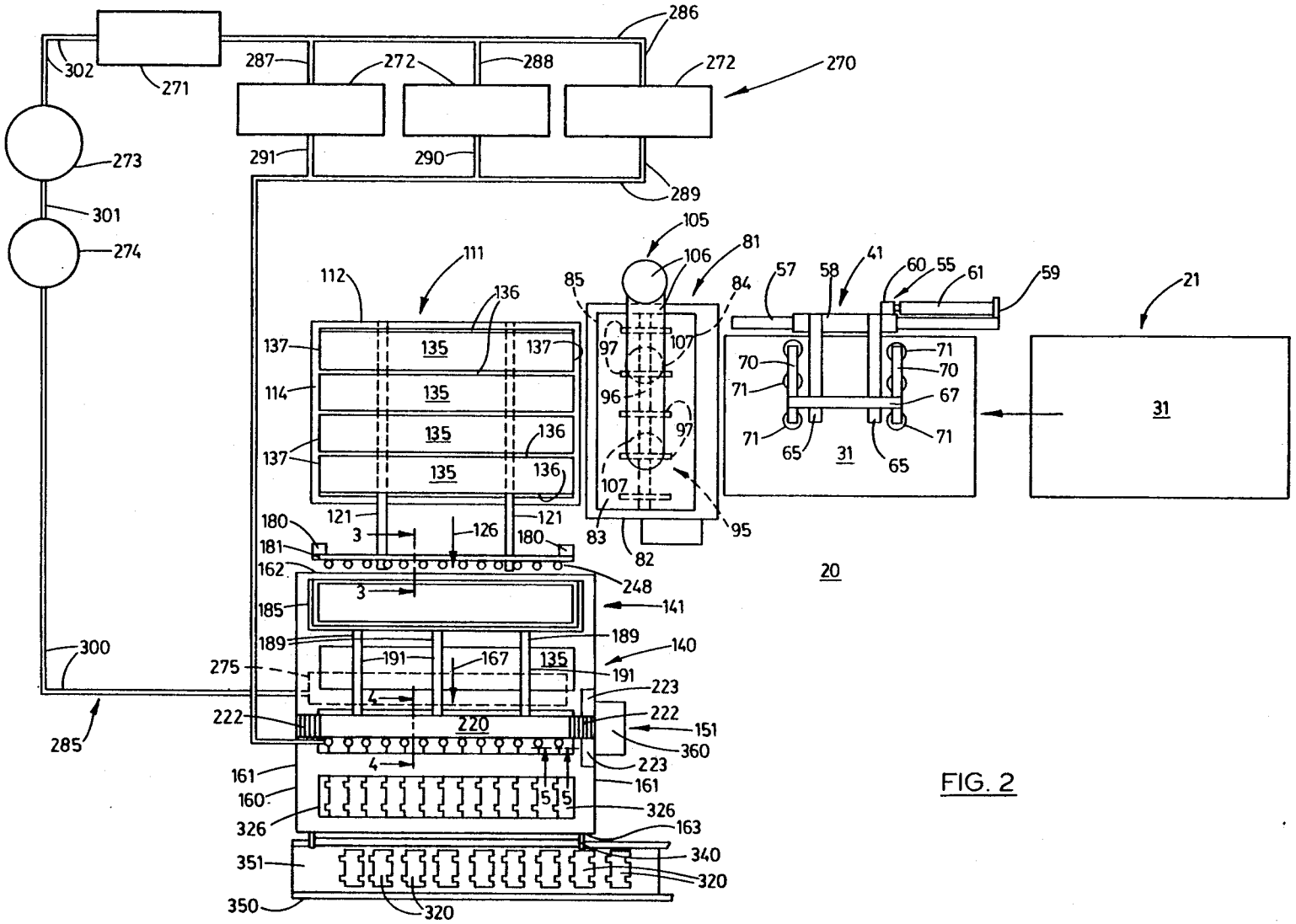
FIG. 2 is a schematic diagram of the apparatus of the present invention shown in top plan view.

A cutting assembly 95 is mounted within the upper housing 83. The cutting assembly includes a blade mounting shaft 96 on which are mounted a plurality of saw blades 97 rotational therewith. The saw blades are substantially equally spaced from each other and are operable to cut each successive panel 31 passing through the upper housing longitudinally along courses to sever the panel into a plurality of segments hereinafter to be discussed. In the illustrative embodiment, as shown in FIGS. 1 and 2, the cutting assembly severs each successive panel into four (4) such segments. A panel feeding assembly 98 is mounted within the upper housing above the discharge opening 85 and includes a roller mounting shaft 99 on which are mounted a plurality of feed rollers 100 so positioned and operable to continue to pull each successive panel through the upper housing as it is being cut into the four (4) segments and thereafter to expel the segments so formed through the discharge opening 85 of the upper housing.

A suitable vacuum system 105 is mounted in operable communication with the interior of the upper housing 83 and includes a primary vacuum duct 106 having a vertical segment and a horizontal segment extending over the upper housing. Secondary vacuum ducts 107 interconnecting the primary vacuum duct and the interior of the upper housing. It will be understood that a suitable vacuum system, not shown, is operably connected to the vacuum system for the purpose of drawing dust and other extraneous matter from the interior of the upper housing for disposal.

The apparatus 10 has a fourth work station, or blank receiving station, 111. The blank receiving station includes a support frame 112 on which are mounted a plurality of rollers 113 for rotational movement about individual axes of rotation parallel to the axes of rotation of the rollers 23 and 46. A stop plate 114 is mounted on the support frame in upstanding relation, as shown in FIG. 1, remote from the discharge opening 85 and parallel thereto.

A conveyor assembly 120 is mounted on the support frame 112. The conveyor assembly includes conveyor support members 121 mounted on the support frame in substantially parallel relation and extending to the left, as viewed in FIG. 1, at approximately the same elevation as the rollers 113 of the support frame. The conveyor support members individually have tracks 122 on the upper surfaces thereof extending longitudinally of the support members. As shown in FIG. 1, conveyor sprockets 123 are individually mounted at the opposite ends of the support members and in spaced relation on the support frame 112 below the sprockets borne by the ends of the support arms on the right, as viewed in FIG. 1. A pair of conveyor chains 124 are individually entrained about the sprockets individual to each of the support members. The conveyor chains mount dogs 125 in corresponding positions such that each corresponding pair of dogs defines an axis extending in substantially right angular relation to the support members 121. The pairs of dogs of the conveyor chains are arranged in spaced pairs such that the segments of the panels formed by the cutting assembly 95 will fit between adjoining pairs of dogs on the conveyor assembly. The conveyor assembly is operable to move the pairs of dogs in a direction of travel 126 along the conveyor from right to left, as viewed in FIG. 1.

Each panel 31, as previously noted, is severed by the cutting assembly 95 to form segments thereof hereinafter to be referred to as blanks 135. Each of the blanks has opposite side edges 136 and opposite end edges 137. The blanks have the elongated rectangular configurations, best shown in FIG. 2. The blanks are expelled from the upper housing 83 through the discharge opening 85 thereof and onto the rollers 113 of the support frame 112 rolling into engagement with the stop plate 114 in the space defined between corresponding pairs of dogs 125 of the conveyor assembly 120. The conveyor assembly is operable to move the blanks in the direction of travel 126 for further processing.

The apparatus 10 includes an end wall forming machine 140, best shown in FIG. 1. The end wall forming machine can be visualized as having a fifth work station, or blank stacking station, generally indicated by the numeral 141 and a sixth work station, or blank severing station, generally indicated by the numeral 151.

Referring generally to the end wall forming machine 140, the forming machine has a main housing 160 mounted on the supporting surface 20 in alignment with the direction of travel 126 of the conveyor assembly 120. The main housing can be visualized generally as having a pair of opposite side portions 161, a front portion 162 and a rear portion 163. The side portions, front portion and rear portion bound a central area 164 for the forming machine. A conveyor assembly 165 is mounted within the central area and includes a plurality of upper runs 166 mounted for movement in a first path of travel 167. It will be understood that the upper runs 166 constituting the upper portion of the conveyor assembly include a plurality of spaced runs moved in the first path of travel along individual courses parallel to each other. The spacing of the upper runs will hereinafter be described in greater detail.

The end wall forming machine 140 mounts a pair of upright support members 180 on opposite sides of the front portion 162 of the main housing 160 extending in vertical relation. An upper support plate 181 is mounted on and interconnects the upright support members on the upper portions thereof facing the rear portion 163 of the main housing 160. A pair of lower mounting plates 182 are individually mounted on the upright support members beneath the upper support plate and extending in the general direction of the rear portion 163 of the main housing 160. A pair of roller mounting shafts 183, each individually mounting a plurality of rollers 184, are mounted on and interconnect the lower mounting plates 182 extending therebetween in spaced substantially parallel relation. The roller mounting shafts, and thereby the rollers thereof, are rotated by a drive system, not shown, in complementary directions operable to draw the blanks 135 therebetween from the conveyor assembly 120.

A blank hopper 185 is mounted on the main housing 160 beneath the roller mounting shafts 183. The blank hopper has a deflecting wall 186 disposed at an oblique angle and bounding an upper opening 187 for the blank hopper larger than and adapted to receive therethrough the blanks 135. The blank hopper has a lower opening 188 disposed in feeding relation to the upper runs 166 of the conveyor assembly 165. The lower opening 188 is dimensioned so as to permit release of the blanks from the interior of the hopper onto the upper runs of the conveyor assembly 165. Three (3) spring members 189 are mounted, as by welding, on the blank hopper extending from mounting portions 190 mounted on the hopper in spaced relation to force applying portions 191 extending in substantially parallel relation to the upper runs 166 of the conveyor assembly 165 to terminal portions 192, best shown in FIG. 4. The spring members are spaced from the upper runs of the conveyor assembly 166 a distance such as can be visualized in FIG. 4 sufficient to exert downward pressure on the blanks during transport by the upper runs of the conveyor assembly 65 while permitting movement therewith. Thus, the spring members operate to retain the blanks in position on the upper runs while not interfering with movement thereby.

The blank severing station 151 has a severing housing 200, best shown in FIG. 1. The severing housing may be visualized as having a front portion 201 and a rear portion 202 defining therebetween a central compartment 203. The rear portion of the severing housing has an access door 204 which may be opened, as shown in FIG. 1, to gain access to the interior thereof. When the access door 204 is in a lowered position, the rear portion of the severing housing and the access door define a discharge passage 205 dimensioned to permit the work objects severed therewithin to be discharged from the severing housing. The purpose of the severing housing is to enclose the central compartment to confine any fluid or extraneous matter that might be released therewithin. Additionally, the severing housing serves the purpose of mounting sound insulating material on the interior surfaces thereof so as to reduce the sound levels otherwise generated thereby.

The severing housing includes a reciprocating beam 220 mounted within the central compartment 203 extending the full length thereof for reciprocating movement in a second path of travel 220. As can be visualized in FIG. 5, the second path of travel 221 is right angularly related to the first path of travel 167. The reciprocating beam can be mounted for such movement by any suitable mechanism, not shown, adapted for the purpose. These mechanisms are protected by accordion-type shrouds 222 enclosing such structures at the opposite ends of the reciprocating beam. A pair of drive motors 223 are mounted in driving relation to this mechanism for moving the reciprocating beam along the second path of travel. The face of the reciprocating beam facing the rear portion 163 of the main housing 160 has a plurality of T-shaped vertical mounting slots 224. The mounting slots may be visualized as arranged in pairs with each pair of mounting slots spaced from the next pair of mounting slots a distance correlated to the distance between the cuts to be made in the blanks 135 to form the work objects, as will hereinafter be described in greater detail.

A plurality of severing head assemblies 230 are individually mounted on the reciprocating beam 220. In the embodiment shown in the drawings, there are thirteen (13) severing head assemblies mounted on the reciprocating beam. A variety of types of severing head assemblies can be employed, such as those manufactured by the Water Jet Cutting Systems Division of Ingersoll-Rand Company of Baxter Springs, Kans. Each of the severing head assemblies has a main housing or block 231 having a pair of side flanges 232. Each severing head assembly is mounted on the reciprocating beam disposed in vertical relation with the side flanges individually overlaying the T-shaped vertical mounting slots 224 of its respective pair and secured in position by bolt and nut assemblies 233. The head of each bolt is received in the longitudinally extending portion of the T-shaped vertical mounting slot, the shaft of the bolt extending through the transverse portion of the T-shaped mounting slot and the nut secured on the bolt to capture the side flange associated therewith against the reciprocating beam. The main block 231 is thus mounted in position. Each main block can be adjusted upwardly and downwardly in the slots by loosening the bolt and nut assemblies for this purpose, repositioning the block, and then retightening the nut and bolt assemblies to bind the side flanges in facing engagement with the reciprocating beam.

A pipe or barrel 234 is mounted in and extends through the main block 231 in vertical relation and has external screw threads 235 at the lower end thereof. A nozzle 236 is screw-threadably mounted on the external screw threads of the barrel. In the illustrative embodiment, the diameter of the orifice of the nozzle is 0.009 of an inch. The barrel has an upper end portion 245 extending above the main block and mounting an externally screw threaded coupling 246. A secondary housing or coupling 247 is screw-threadably received on the externally screw threaded coupling 246.

Figures 3, 4:
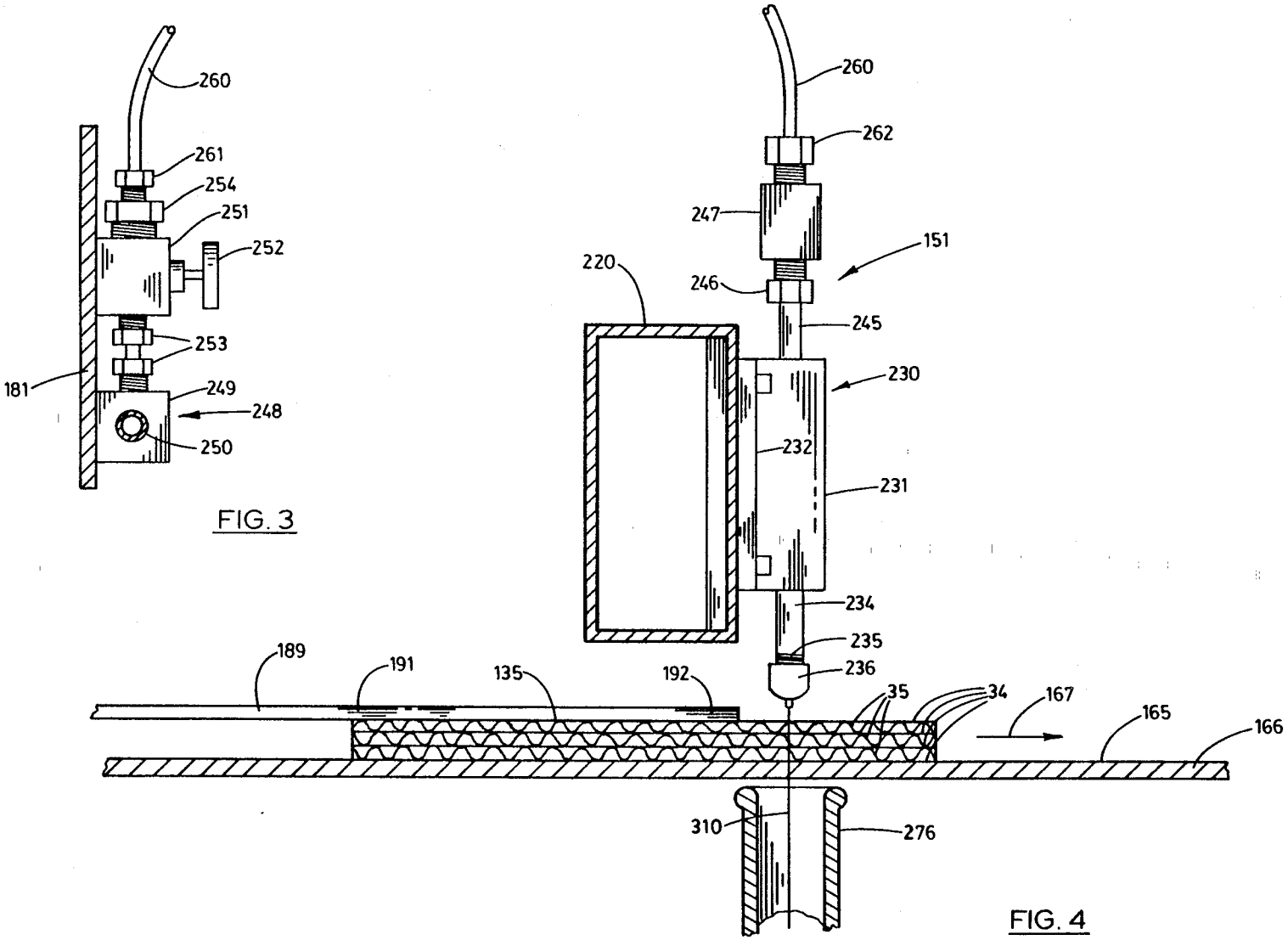
FIG. 3 is a somewhat enlarged fragmentary, longitudinal vertical section taken on line 3—3 in FIG. 2.
FIG. 4 is a somewhat enlarged fragmentary, longitudinal vertical section taken on line 4—4 in FIG. 2.

A fluid supply manifold 248 is mounted on the upper support plate 181 above the front portion 162 of the main housing 160. The fluid supply manifold includes, in the embodiment shown in the drawings, thirteen (13) housings or blocks 249 individually mounted in spaced relation on the upper support plate 181. The blocks 249 are individually interconnected by a series of manifold pipes 250 and each of the blocks contains an inverted T-shaped passage wherein the horizontal portion of the T-shaped passage interconnects the manifold pipes and the vertical portion of the T-shaped passage extends upwardly through the top of the block. A control valve 251 is mounted on the upper support plate 181 above each of the blocks 249, as best shown in FIG. 3. Each control valve has a valve handle 252 operable to adjust the valve between operational opened and closed positions. A lower coupling assembly 253 interconnects each of the blocks 249 with its respective control valve thereabove. Thus, a fluid passage is established in the fluid supply manifold 248 through the manifold pipes and blocks 249 to the control valves 251.

An upper coupling 254 is mounted on the top of each of the control valves in fluid receiving relation from its respective control valve. A fluid supply tube 260, having a first coupling 261 at one end thereof and a second coupling 262 at the opposite end thereof, is mounted so as to interconnect the coupling 254 of its respective control valve 252 by screw-threadably securing the first coupling 261 in the upper coupling 254 thereof and at its opposite end by screw-threadably securing the second coupling 262 in the coupling 247 of its respective severing head assembly 230. Each of the supply tubes is extended in an arc and possesses sufficient flexibility to move with the reciprocating beam 220 while maintaining an unrestricted path for fluid flow therethrough.

Referring more particularly to FIG. 2, the apparatus 10 includes a fluid supply system generally indicated at 270. The operative portions of the fluid supply system can be of a variety of types such as those manufactured by the Water Jet Cutting Systems Division of Ingersoll-Rand Company of Baxter Springs, Kans. The fluid supply system includes a polymer mixer 271 operable to mix a polymer with fluid. The fluid supply system includes three (3) intensifiers 272 operable to increase fluid pressure within the fluid supply system. The fluid supply system includes a booster pump 273 and a filter 274. The fluid supply system also includes a collection reservoir 275 mounted on the supporting surface 20 beneath the main housing 160 in the position shown in hidden lines in FIG. 2. A plurality of receiving conduits 276 are mounted on the collection reservoir and extend to positions in vertical alignment with the nozzles 236 of the severing head assemblies 230, as best shown in FIG. 4.

The fluid supply system 270 has a fluid circuit 285 including a first conduit 286 interconnecting the polymer mixer 271 and the intensifier 272 on the right, as viewed in FIG. 2. A second conduit 287 interconnects the first conduit 286 and the intensifier 272 on the left, as viewed in FIG. 2. A third conduit 288 interconnects the first conduit 286 and the intensifier 272 in the middle, as viewed in FIG. 2. A fourth conduit 289 interconnects the intensifier 272 on the right, as viewed in FIG. 2, and one of the manifold pipes 250 of the fluid supply manifold 248. A fifth conduit 290 interconnects the middle intensifier, as viewed in FIG. 2, and the fourth conduit 289. A sixth conduit 291 interconnects the intensifier 272 on the left, as viewed in FIG. 2, and the fourth conduit 289. A seventh conduit 300 interconnects the collection reservoir 275 and the filter 274. An eight conduit 301 interconnects the filter 274 and the booster pump 273. A ninth conduit 302 interconnects the booster pump 273 and the polymer mixer 271.

The fluid supply system 270, as so configured, is adapted to be charged with a cutting fluid, preferably water, which is mixed in the polymer mixer 271 with a polymer which is operable to make the water cohere when released as a jet rather than to tend to produce some lateral dispersement from the jet, as would otherwise be the case. The booster pump 273 and intensifiers 272 are operable to produce fluid pressures within the fluid supply system of roughly forty-five thousand pounds per square inch (45,000 psi) to fifty thousand pounds per square inch (50,000 psi) or higher. The filter 274 is, of course, operable to filter out any extraneous matter that may enter the system such as, particularly, through the receiving conduits 276. Referring more particularly to FIG. 4, each of the nozzles 236 is operable to release a fluid jet 310 at high velocity. The fluid jet, thus, defines a severing plane 311 which, except when the reciprocating beam 220 is moved in the second path of travel 221, is vertical and parallel to the first path of travel 167, as shown in FIG. 5.

Figure 5:
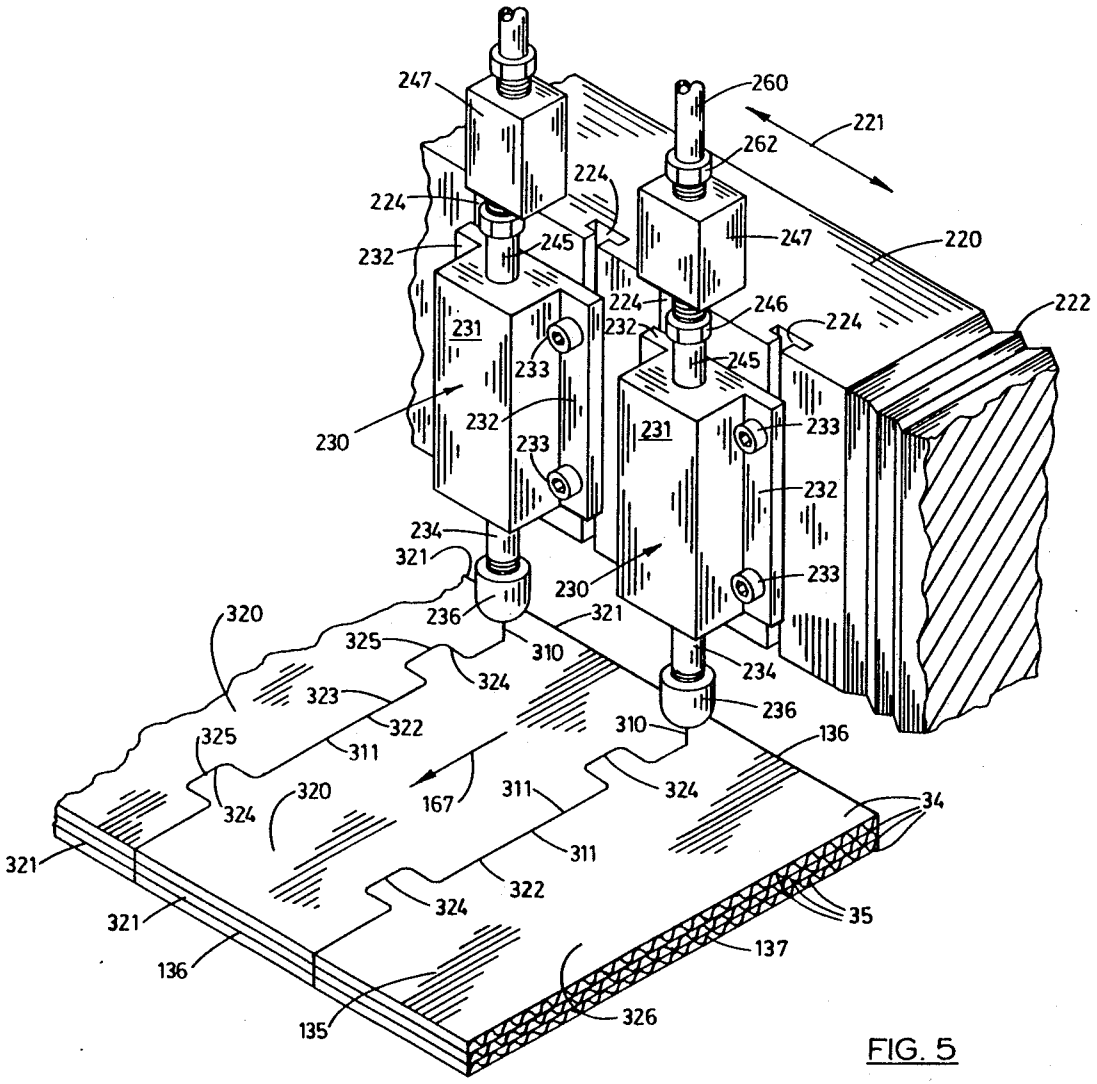
FIG. 5 is a somewhat further enlarged fragmentary, perspective view showing two of the severing head assemblies of the present invention mounted on the reciprocating beam thereof and operating to sever a blank of laminate material into work objects, in this case, end walls.

As shown in FIG. 5, the apparatus 10 is operable to sever each of the blanks 135 into a plurality of end walls 320. In the illustrative embodiment of the drawings, the apparatus 10 is operable to sever each blank into twelve (12) such end walls. Each of the end walls has parallel opposite side edges 321 corresponding to the side edges 136 of the blank 135. Each end wall has a lower edge 322 substantially right angularly related to the side edges 321 thereof and an upper edge 323 also substantially right angularly related to the side edges 321. A pair of recesses 324 are formed in the lower edge of each end wall. A pair of projections 325 are provided on the upper edge 323 of each end wall. As can be seen in FIG. 5, the projections and recesses are disposed on their respective edges in the same positions and are of the same dimensions and configurations so as to interfit in mating relation. As shown in FIGS. 2 and 5, each blank 135, when severed by the apparatus of the present invention in the illustrative embodiment, has portions 326 to be discarded at the opposite ends thereof.

A discharge ramp 340 is mounted on the rear portion 163 of the main housing 160. The discharge ramp has a pair of mounting plates 341 mounted on the rear portion of the main housing in spaced relation to each other and interconnected by cylindrical rollers 342 mounted individually for rotational movement about individual substantially parallel axes of rotation right-angularly related to the first path of travel 167.

The apparatus 10 has a discharge conveyor assembly 350, shown in FIGS. 1 and 2, mounted on the supporting surface 20 in receiving relation to and beneath the discharge ramp 340. The discharge conveyor assembly mounts a conveyor belt 351 having an upper run 352 which is driven, by a suitable drive mechanism, not shown, in a direction of travel 353 from left to right, as viewed in FIG. 2.

The apparatus 10 has a computer control system 360 which can be of any suitable type and which is operatively linked to the required operating components of the apparatus 10 through any suitable electrical system, not shown, for controlled operation of the apparatus. The computer control system is operable, for example, to control the various speeds of the various conveyors of the apparatus to deliver the panels 31, blanks 135 and end walls 320 so formed through the apparatus. Most importantly, the computer control system operates to control the speed of the upper runs 166 of the conveyor assembly 165 in the first direction of travel 167 and the reciprocation of the reciprocating beam 220 in the second path of travel 221. The computer control system can, thus, be programmed to operate these mechanisms in a cooperative fashion to sever the blanks in substantially any desired configurations along severing planes as defined thereby. Similarly, the severing head assemblies 230 can be repositioned vertically and laterally on the reciprocating beam to, in effect, move the severing planes 311 closer to each other, or farther from each other, so as to sever the blank to form work objects of different sizes.

OPERATION

The operation of the described embodiment of the subject invention in the practice of the method of the present invention is believed to be readily apparent and is briefly summarized at this point. Referring more particularly to FIGS. 1 and 2, using a forklift or the like, pallets 30 on which are stacked a plurality of the panels 31 are delivered to and rested upon the rollers 23 of the support frame 22 and the rollers 46 of the support frame 45. If the panels are lashed to the pallets, such binding material is removed prior to operation of the apparatus 10.

The panel loading assembly 55 is then operated to expand the hydraulic cylinder assemblies 72 to move the vacuum cups 71 at least a short distance away from the panel guide rail 87. Similarly, the air cylinder 69 are operated to move the vacuum cups into engagement with the panel 31 on the top of the stack immediately therebelow. The vacuum system, not shown, is then operated to draw a vacuum within the vacuum cups 71 so as to cause them to adhere to the uppermost panel 31. The air cylinders 69 are then retracted while maintaining the vacuum through the vacuum cups so as to raise the panel to the elevation of the guide rail 87. The hydraulic cylinder assemblies 72 are then contracted to draw the adjacent side edge 32 of the panel into engagement with the panel guide rail 87. Through this action, the panel is now disposed at the same elevation as the entrance opening 84 of the upper housing 83 within the panel cutting station and aligned therewith.

Subsequently, the hydraulic cylinder assembly 61 of the panel loading assembly 55 is expanded to move the slide member 58 along the horizontal tubular guide beam 57 thereby moving the leading end edge 33 of the panel over the entrance platform 86 and into the entrance opening 84. Once the leading end edge is within the entrance opening 84, the intake feed roller 88 which is continuously rotating engages and draws the panel into the upper housing at the same time the vacuum system shuts off the vacuum applied through vacuum cups 71 permitting the panel to be drawn in to the upper housing in slidable movement along the entrance platform 86. Such movement of the intake feed roller draws the leading end edge of the panel 31 into engagement with the saw blades 97 which are rotating at high speed thereby severing the panel along the planes defined by the saw blades. Movement of the panel is continued as such sawing continues and the resulting blanks 135 are engaged by the feed rollers 100 of the panel feeding assembly 98 to continue movement of the blanks as they are being severed from the panel.

Once the blanks 135 have completely been severed from the panel 31, the feed rollers 100 expel the blanks in side by side relation from the upper housing 83 through the discharge opening 85 thereof and onto the support table or frame 112 in the blank receiving station 111. The velocity of the blanks upon such discharge from the upper housing is such that they continue movement along the rollers 113 of the support frame until the end edges 137 of the blanks move into engagement with the stop plate 114 and thereby reach the position, shown in FIGS. 1 and 2.

At this point, the conveyor assembly 120 is operated to draw a pair of dogs 125 thereof into engagement with the blank 135 on the support frame 112 in the uppermost position, as shown in FIG. 2. Movement of the conveyor is continued so that the dogs 125 draw the blanks, which are drawn into engagement with each other thereby, along the rollers 113 of the support frame in the direction of travel 126 toward the blank stacking station 141. Movement of the blanks in the direction of travel 126 is continued until the blanks pass over into the terminal ends of the conveyor support members 121 at which point each is grasped in sequence by the rollers 184. The rollers are rotated to grasp and draw each blank in succession from the conveyor assembly 120 and discharge it into the blank hopper 185. The deflecting wall 186 of the blank hopper 185 operates to direct each blank 135 into the upper opening 187 of the hopper. The blanks 135 are thus received in stacked relation within the blank hopper with the lower most blank 135 in succession being received in the lower opening 188 of the blank hopper in rested engagement with the upper runs 166 of the conveyor assembly 165. The upper runs moving in the first path of travel 167 withdraw each lowermost blank 135 from the lower opening 188 of the blank hopper 185 in succession so that the blanks are drawn along in the first path of travel in spaced relation to each other as can best be visualized in FIG. 1.

As the blanks 135 are drawn in the first path of travel 167, they are drawn beneath the force applying portions 191 of the spring members 189. The blanks are thus held in position on the upper runs of the conveyor assembly while being permitted to move in the first path of travel. Thus, each blank arrives in the blank severing station 151 with a side edge 136 thereof disposed in right angular relation to the first path of travel 167 and held beneath the force applying portions 191 of the spring members 189, as can be visualized in FIG. 4.

At this time, the fluid supply system 270 is operating and energized so that the fluid jets 310 defining severing planes 311 are in continuous operation from their respective severing head assemblies 230. Thus, as movement of each respective blank is continued in the first path of travel 167, each fluid jet 310 cuts into and, thus, severs the blank along the severing plane 311 beginning with the leading side edge 136 thereof.

Under the control of the computer control system 360, the reciprocating beam 220 is retained in a stationary position until the point is reached in such severing for the formation of the first recess 324 and projection 325 of each end wall 320. At this point, the reciprocating beam is moved to the left, as viewed in FIG. 5, in the second path of travel 221 so as to form the leading edges of the projections and recesses. Once the programmed length of the projections and recesses is formed, movement of the reciprocating beam in the second path of travel is terminated so that continued movement of the blank along the first path of travel causes the fluid jet to sever the blank in a course once again parallel to the path of travel 167. Once the programmed width for the projections and recesses has been achieved, the reciprocating beam is then moved to the right, as viewed in FIG. 5, in the second path of travel so as to form the trailing edges of the projections and recesses. Once the fluid jet reaches the point at which it initially started the severing operation, movement of the reciprocating beam is terminated so that severing of the blank is again continued along a course parallel to the first path of travel 167. Formation of the second projection and recess of each end wall is accomplished in precisely the same manner thereby forming a pair of mated projections and recesses. As movement of the blank in the first path of travel 167 is continued, severing of the blank by the fluid jet 310 is continued until the blank passes beyond the fluid jet and the fluid jet severs through the trailing side edge 136 of the blank.

As can be visualized upon reference to FIGS. 2 and 5, the completion of the severing operation with respect to one blank 135 produces twelve (12) end walls 320 disposed in mating relation to each other with interlocked recesses 324 and projections 325 together with two (2) discarded portions 326, one each at the opposite ends of what was once the blank 135. The critical lower edge 322 and upper edge 323 of each end wall are precisely formed with shear vertical surfaces dependably conforming to tolerances significantly closer than has ever before been achievable in the art. Similarly, the flutes of the corrugations of the corrugated paper laminations 35 within the end walls so formed are not crushed or otherwise deformed to any degree. As a consequence, the end walls, so formed, are of significantly enhanced strength over that heretofore achievable in the art and yet are produced on a mass produced, assembly line basis at a cost consistent with conventional methods and apparatuses.

The interlocked end walls 320 pass out of the discharge passage 205 of the severing housing 200 and down the cylindrical rollers 342 of the discharge ramp 340. Such passage causes loosening of the interlocking engagement between the projections 325 and recesses 324 of the previously interlocked end walls 320. Thereafter, as the end walls fall onto the upper run 352 of the discharge conveyor assembly 350, they are typically disengaged from each other and, thus, are carried in side by side relation on the upper run 352 of the discharge conveyor assembly in the direction of travel 353. The end walls are thereafter collected, stacked and banded together in units for shipment to a container assembly plant or for delivery to another point in the plant for assembly into a container in combination with a wrapper, not shown.

It will be seen that programming of the computer control system 360, adjustment of the positions of the severing head assemblies 231 and varying of the interoperative systems of the apparatus 10 of the present invention permits it to be adapted for the construction of a wide variety of types of work objects during the severing operation. The work objects which can be formed using the method and apparatus cannot only be of different sizes, but also of different configurations as permitted by these interoperations.

Therefore, the present invention provides a method and apparatus for severing work objects which are operable to form such work objects within tolerances not heretofore achieved in the art and are capable of unvarying precision throughout a long operational life; which have particular utility in the severing of laminate work objects such as end walls employed in the construction of containers operable to form work objects from such laminate materials having intricately formed marginal edges; and which are capable of the mass production of such work objects with unvarying accuracy without the host of difficulties presented by the prior art methods and apparatuses.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. A method for manufacturing end walls for containers in which the end walls are formed from a plurality of large, substantially flat panels of laminated paper each panel containing at least two laminations of substantially flat paper and at least two laminations of corrugated paper, and the end walls to be manufactured each have an upper edge from which at least one projection is extended and a lower edge in which at least one recess is formed, the method comprising the steps of:

A. transporting said panels along a first path of travel substantially in single file relation;

B. severing each of said panels during said transporting in said single file relation along substantially parallel courses substantially parallel to the direction of movement in said first path of travel to form a plurality of elongated blanks of said laminated paper each of which has substantially parallel sides and substantially parallel ends substantially right-angularly related to said sides thereof;

C. transporting said blanks in substantially single file relation along a second path of travel substantially right-angularly related to said sides of the blanks in said second path of travel;

D. directing a plurality of focused, high pressure fluid jets along substantially equally spaced, substantially parallel paths substantially right-angularly related to said blanks to sever each of said blanks from side to side thereof; and E. moving said plurality of fluid jets in unison during said directing step in a predetermined pattern substantially transversely of said second path of travel as the blanks are transported in the second path of travel substantially simultaneously to sever said blanks into a plurality of said end walls having said projections and recesses.

2. The method of claim 1 in which in use the projections of each end wall are adapted to interfit with the recesses of another of said end walls in substantially matting relation and wherein in said moving step said fluid jets are moved individually in accordance with said predetermined pattern to sever said blank along a severing plane forming the projections of one end wall on one side of said severing plane and the recesses of a second end wall on the other side of said severing plane whereby the projects and recesses can be so interfitted.

3. An apparatus for severing work objects constructed of laminate materials embodied in large, substantially flat panels having at least two substantially flat layers interlaminated with at least two corrugated layers, the apparatus comprising a first conveyor for transporting said work objects along a first path of travel in a predetermined direction; a cutting assembly operable successively to cut each of said panels into a plurality of blanks individually having longitudinal axes disposed in substantially side by side relation; a plurality of severing head assemblies individually operable to direct high pressure fluid jets along substantially equally spaced substantially parallel axes; means mounting said severing head assemblies in juxtaposition to the first conveyor; a moving assembly operable to move the mounting means substantially transversely of the first path of travel in a second path of travel substantially right-angularly related to the axes of the fluid jets and substantially right-angularly related to said predetermined direction in said first path of travel whereby the work objects are successively severed by the fluid jets into configurations defined by movement of the blanks in the first path of travel and by movement of the mounting means and thereby said fluid jets; at least two spring members borne by the apparatus in juxtaposition of the first path of travel for slidably engaging the blanks during transport in the first path of travel during said severing to restrain the blanks in position thereon from displacement during said severing; a second conveyor between said cutting assembly and the first conveyor operable to transport the blanks from the cutting assembly for receipt by the first conveyor; and a hopper disposed between the second conveyor and the first conveyor operable individually to receive said blanks from the second conveyor, dispose said blanks so received in stacked relation therewithin and individually to dispense said blanks therefrom onto the first conveyor.

4. The apparatus of claim 3 including a fluid supply system including a source of said fluid, means for pressurizing the fluid to said high pressure and a plurality of supply tubes individually connected to said source at common ends thereof and individually connected to said severing head assemblies at opposite common ends thereof and wherein the supply tubes are of sufficient flexibility to accommodate said reciprocal movement of the mounting means and thereby the severing head assemblies in said second path of travel.

5. An apparatus for manufacturing end walls for containers in which the end walls are formed from a plurality of large, substantially flat panels of laminated paper, each panel containing at least three laminations of substantially flat paper and three laminations of corrugated paper, and the end walls to be manufactured each have an upper edge from which two projections are extended and a lower edge in which two recesses are formed and wherein the projections of the end walls of one of said containers are adapted individually to mate with the recesses of the end walls of another of said containers in stacked relation, the apparatus comprising:

A. a panel loading assembly including a platform for the receipt of a plurality of said panels in stacked relation thereon and means for individually grasping successive panels from the stack and moving them along a predetermined course;

B. a panel cutting assembly including a plurality of saw blades disposed substantially in alignment with said predetermined course and arranged in spaced relation to each other and means for drawing each successive panel from said predetermined course into the saw blades for cutting each successive panel into a plurality of elongated blanks and means for expelling said blanks from the cutting assembly;

C. a blank receiving table disposed in receiving relation to the blanks expelled from the panel cutting assembly including a stop plate disposed for endward engagement with the blanks as they are expelled from the panel cutting assembly to stop them in substantially side by side relation on the blank receiving table with longitudinal axes of the blanks disposed in substantially parallel relation;

D. a first conveyor engageable with the blanks on the blank receiving table and operable to transport said blanks from the receiving table along a course substantially right-angularly related to said longitudinal axes of the blanks to a discharge position;

E. a hopper disposed substantially beneath said discharge position of the conveyor dimensioned for receipt of the blanks from the discharge position of said conveyor in stacked relation therewithin and having a lower opening dimensioned for the individual release of the blanks therethrough;

F. a second conveyor disposed in blank receiving relation to the lower opening of the hopper operable to receive said blanks from said lower opening and to transport said blanks in spaced substantially parallel relation along a first path of travel in a predetermined direction substantially right-angularly related to the longitudinal axes of the blanks;

G. a reciprocating assembly mounted above the first path of travel including a member reciprocal by said assembly in a second path of travel substantially parallel to the longitudinal axes of the blanks and substantially right-angularly related to said predetermined direction of the first path of travel;

H. a fluid system including a plurality of nozzles mounted on said member of the reciprocating assembly in predetermined, substantially equally spaced relation and means for pressurizing the fluid system to discharge high pressure, coherent jets of fluid from said nozzles along individual axes substantially parallel to each other and substantially right-angularly related to the longitudinal axes of the blanks in sufficient pressure to sever said blanks; and I. a control system operably connected to the apparatus for moving the second conveyor to move said blanks in said direction in the first path of travel and the member of the reciprocating assembly in said second path of travel so as to sever each blank passing beneath the member of the reciprocating assembly along courses forming a plurality of said end walls each having an upper edge from which two of said projections are extended and a lower edge having two of said recesses.

6. A method for manufacturing end walls for containers in which the end walls are formed from a plurality of substantially flat panels of laminated paper, each panel containing at least one lamination of corrugated paper and the end walls to be manufactured each having an upper edge from which at least one projection is extended and a lower edge in which at least one recess is formed, the method comprising the steps of:

A. severing each of said panels to form a plurality of elongated blanks of said laminated paper each of which has substantially parallel sides and substantially parallel ends substantially right-angularly related to said sides thereof;

B. transporting said blanks along a path of travel substantially right-angularly related to said sides of the blanks in said path of travel;

C. directing a plurality of high pressure fluid jets along substantially equally spaced, substantially parallel paths individually to sever said blanks from side to side thereof; and D. moving said plurality of fluid jets in unison during said directing step in a predetermined pattern substantially transversely of said path of travel as the blanks are transported in said path of travel substantially simultaneously to sever said blanks into a plurality of said end walls having said projections and recesses.

7. An apparatus for manufacturing end walls for containers in which the end walls are formed from a plurality of substantially flat panels of laminated paper, each panel containing at least one lamination of corrugated paper and the end walls to be manufactured each having an upper edge from which at least one projection is extended and a lower edge in which at least one recess is formed, the apparatus comprising:

A. means for severing the panels into a plurality of elongated blanks;

B. means for transporting said blanks in substantially parallel relation along a first path of travel substantially right-angularly related to the longitudinal axes of the blanks;

C. a reciprocating assembly mounted above the first path of travel including a member reciprocal by said assembly in a second path of travel substantially parallel to the longitudinal axes of the blanks and substantially right-angularly related to the first path of travel;

D. a fluid system including a plurality of nozzles mounted on said member of the reciprocating assembly and means for pressurizing the fluid system to discharge high pressure jets of fluid from the nozzles along individual axes substantially parallel to each other in sufficient pressure to sever said blanks; and E. a control system operably connected to the apparatus for moving said blanks in said first path of travel and the member of the reciprocating assembly in said second path of travel so as to sever each blank passing beneath the number of the reciprocating assembly along courses forming a plurality of said end walls each having an upper edge from which at least one of said projections is extended and a lower edge having at least one of said recesses.

* * * * *

UNITED STATES PATENT AND TRADEMARK OFFICE

CERTIFICATE OF CORRECTION

PATENT NO. : 5,269,211

DATED : DECEMBER 14, 1993

INVENTOR(S) : MAX L. FLAMING

It is certified that error appears in the above-identified patent and that said Letters Patent is hereby corrected as shown below:

Column 12, line 58, after "to the"

insert ---first---.

Column 14, line 62, delete "spaced" and substitute

---spaced,---.

Signed and Sealed this

Twenty-sixth Day of April, 1994

*Attest:*

*Attesting Officer*

BRUCE LEHMAN

*Commissioner of Patents and Trademarks*